US007121965B2

(12) United States Patent
Riley

(10) Patent No.: US 7,121,965 B2
(45) Date of Patent: Oct. 17, 2006

(54) ICE-HOCKEY GOAL FRAME WITH PUCK DEFLECTOR

(75) Inventor: Terence William Riley, Princeton (CA)

(73) Assignee: Ontario Inc., Woodstock (CA)

( * ) Notice: Subject to any disclaimer, the term of this patent is extended or adjusted under 35 U.S.C. 154(b) by 25 days.

(21) Appl. No.: 10/833,281

(22) Filed: Apr. 28, 2004

(65) Prior Publication Data

US 2004/0214667 A1 Oct. 28, 2004

(30) Foreign Application Priority Data

Apr. 28, 2003 (GB) ..... 0309622.9

(51) Int. Cl.
*A63B 63/00* (2006.01)

(52) U.S. Cl. ..... 473/478

(58) Field of Classification Search ..... 473/476, 473/478, 415

See application file for complete search history.

(56) References Cited

U.S. PATENT DOCUMENTS 2,543,404 A * 2/1951 Harasty ..... 114/219
2,935,855 A * 5/1960 Reid ..... 405/215
3,179,397 A * 4/1965 Cleereman et al. ..... 267/140
3,475,025 A 10/1969 Uphaus
3,822,883 A 7/1974 De Vos
4,083,561 A 4/1978 Daffer, Jr.
4,579,344 A * 4/1986 Meggs ..... 473/478
4,619,456 A 10/1986 Meggs
5,088,740 A 2/1992 Peterson
5,246,229 A * 9/1993 Carey ..... 473/432
5,247,897 A * 9/1993 Pepp ..... 114/219
5,346,227 A * 9/1994 Amram et al. ..... 273/400
D356,353 S 3/1995 Broyles et al.
5,427,381 A 6/1995 Macaluso et al.
5,524,901 A 6/1996 Bison et al.
5,571,266 A 11/1996 Nichols
5,730,077 A * 3/1998 Nunes et al. ..... 114/219
5,816,947 A 10/1998 Kavitch
5,934,679 A 8/1999 Strain et al.
6,247,699 B1 6/2001 Macaluso
6,723,011 B1 * 4/2004 Van Helvert et al. ..... 473/478
2002/0115508 A1 8/2002 Bourdges

* cited by examiner

*Primary Examiner*—Eugene Kim
*Assistant Examiner*—M. Chambers
(74) *Attorney, Agent, or Firm*—Anthony Asquith Corp.

(57) ABSTRACT

The puck-deflector is a one-piece moulding in polyurethane, having a sloping apron for deflecting the puck up and into the net. The puck-deflector fits around the bottom pipe of the goalframe, and prevents incoming pucks from striking the bottom pipe, and rebounding back out over the goal-line.

33 Claims, 13 Drawing Sheets

37
A 39
28
40
38
31
29
HB
HA 36
40
53
50
52
34
54
38

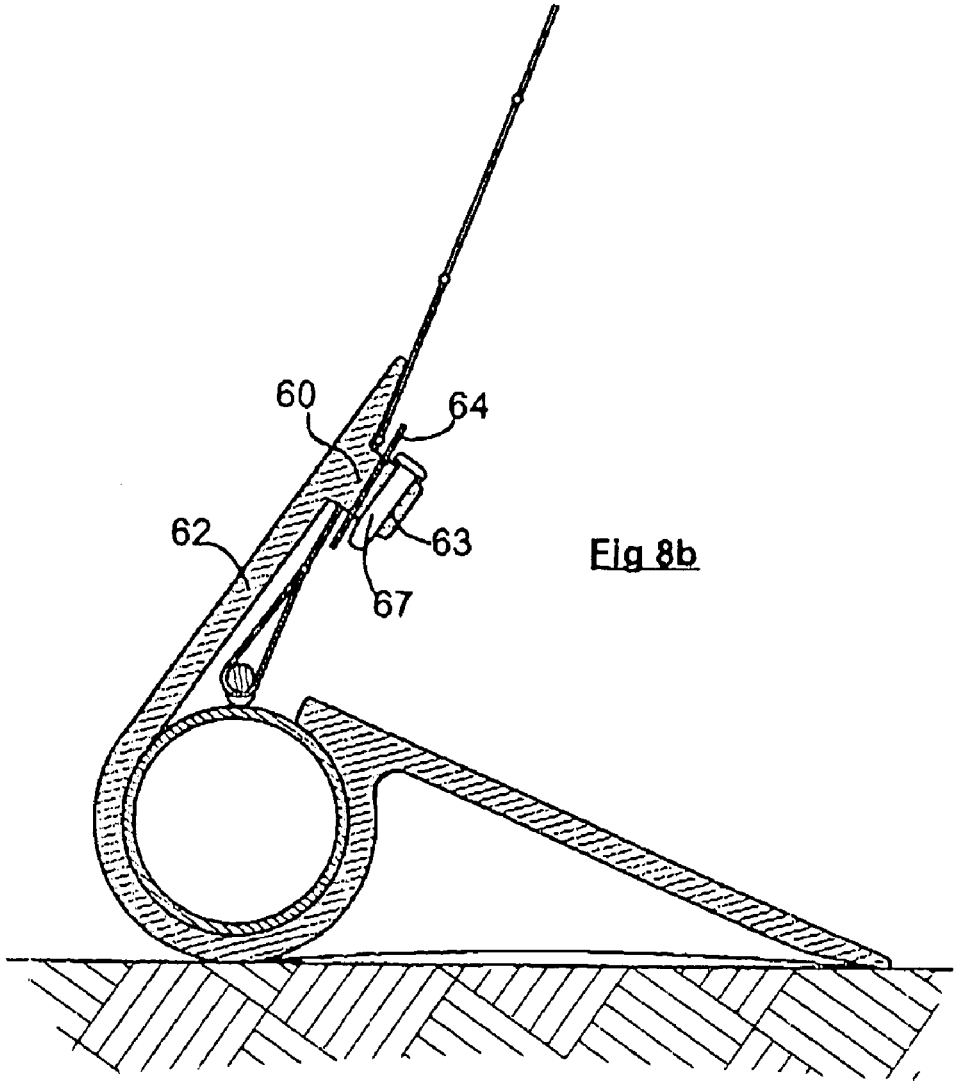
Fig 8b
Fig 8c
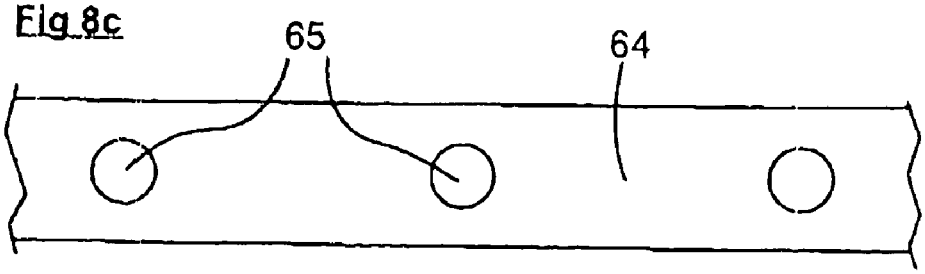

ICE-HOCKEY GOAL FRAME WITH PUCK DEFLECTOR

This invention relates to goalframes to be used in the game of ice-hockey, and to the provision of a deflector which acts to absorb the impact of a puck that has entered the net, and prevent it from bouncing and rebounding back out over the goal-line.

BACKGROUND TO THE INVENTION

A hockey goal-frame includes a bottom-pipe, which rests on the ice, and to which the net is secured. As disclosed in U.S. Pat. No. 4,579,344 (Meggs, 1986), impact-bags may be tied to the bottom-pipe. The impact-bags have been stuffed with a soft impact-deadening material. One of the problems is that the bag material is not watertight, and water entering the bag freezes and sticks to the ice; when pulled free, the bag material can become torn, which allows the stuffing material to spill out. Furthermore, hockey goalframes are usually stored in equipment rooms away from the ice surface, and the goalframes have to be dragged over a concrete floor, which can abrade the bag material. The stuffing is usually in the form of grains or pellets of various impact-absorbing materials, which may be difficult to deal with if they spill out onto the ice. It has been conventional for impact-bags to have to be replaced e.g each season.

Also, with the conventional impact-bags, the impact-absorbing properties are not perfect, in that as many as say twenty percent of pucks that strike the bottom-pipe (i.e strike the bag lying in front of the bottom-pipe) do in fact bounce and rebound enough to end up outside the goal-line.

The problem with bounce-out is not so much where it is clear to the goal-judge or the participants that the puck has hit the bottom-pipe and bounced out; the problem is that some participants, knowing that bounce-out is possible, may be disposed to allege that it has happened in cases where it is not so clear.

It used to be conventional for the bottom-pipes of goal-frames to be in the shape of the number-3. When the bottom-pipe is straight (as is now more usually the case), it is the pucks that are shot from directly in front that tend to bounce out; the 3-shape deflected the in-front puck to left or right, which was effective to cause the puck to be retained. However, the 3-shape was dangerous in that a player sliding into the goal might strike the point in the middle of the 3-shape, and be injured.

Instead of the impact-bags made of fabric, puck deflectors made of metal have been used. However, again, hockey goals are dragged over concrete, and it could happen that the edge of the metal deflector became sharpened to a knife edge; if the edge were knocked upwards when a player crashed into the goal, it could cause injury.

The metal puck-deflectors worked by deflecting the puck upwards, whereupon the puck could be caught by the net. However, a metal deflector has little capacity to deaden or absorb impacts.

It is also known to provide a protective skirt on the outside of the net. The skirt fits to or around the bottom-pipe, and extends a few inches up the net. The purpose of the skirt is to protect the lowermost meshes of the net from being cut by skate blades, and otherwise damaged.

It is an aim of the invention to provide a puck-deflector for a hockey goal, which is capable of preventing bounce-back of the puck back over the goal-line in respect of a much larger percentage of shots than has been the case hitherto; which poses little risk of injury to players crashing into the net; and which is inexpensive, and can be expected to have a long and trouble-free service life.

GENERAL FEATURES OF THE INVENTION

The present invention lies in providing the puck-deflector as a plastic moulding. Preferably, the plastic material should inherently have good impact absorbing properties, i.e the material should be "dead", from the standpoints of elasticity and resilience. Moulded polyurethane has been found to have excellent properties for use in the invention. Polyurethane has the property that it can be moulded by simply being poured into the mould in pre-liquid form, either cold or hot, whereby no injection pressure or compression pressure is required. Thus, moulds suitable for pour-moulding polyurethane can be relatively inexpensive, which is advantageous for small batch production, and which therefore suite the hockey-goal market. In addition, pour-moulded polyurethane has the property of being "dead", from the puck bounce-back standpoint.

The moulded puck-deflector of the invention preferably includes an apron with a sloping upper surface, which can act to deflect the puck upwards and into the mesh of the net. The sloping upper surface extends down almost, but preferably not quite, to the ice surface.

Preferably, the plastic moulded puck-deflector is so shaped as to fit over the bottom-pipe from underneath. Preferably, a net-protecting skirt is incorporated into the moulded form of the puck-deflector.

DETAILED DESCRIPTION OF PREFERRED EMBODIMENTS

By way of further explanation of the invention, exemplary embodiments of the invention will now be described with reference to the accompanying drawings, in which:

FIG. 1 is a pictorial view of an exemplary goalframe for use with a puck-deflector which embodies the invention;

FIG. 2 ;is a cross-section of a bottom-pipe of the goal-frame of FIG. 1, with the puck-deflector attached;

Figure 3:
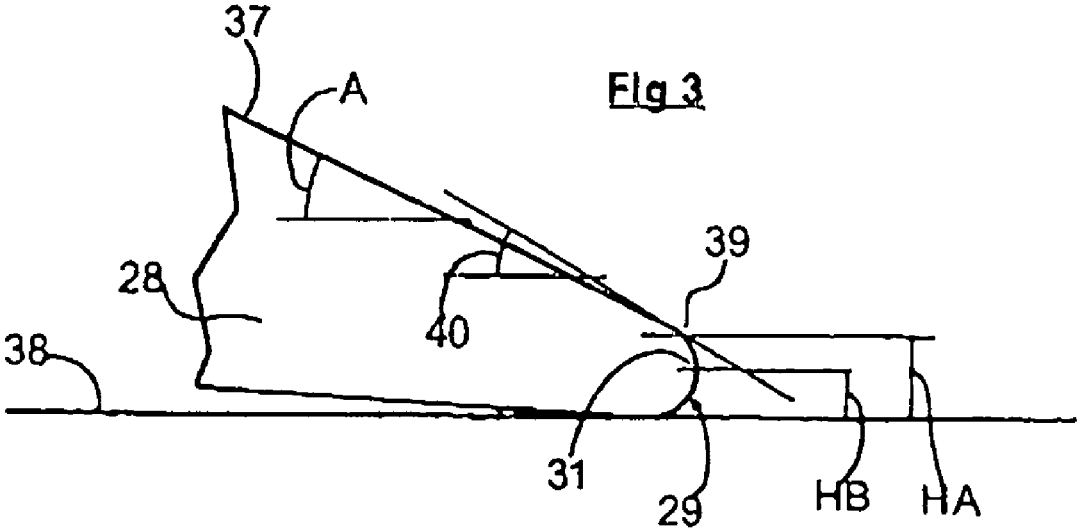
FIG. 3 is a close-up of the profile of the front-edge of the puck-deflector of FIG. 2.
Figure 8A:
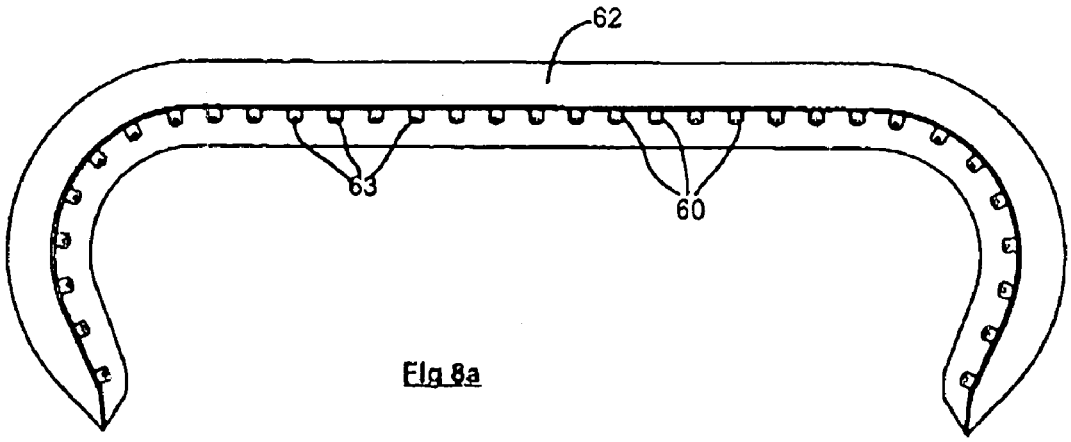

FIG. 8*a* is a plan view of another puck-deflector;

FIG. 8*b* is a section, like FIG. 3, of the puck-deflector of FIG. 8*a;*

FIG. 8*c* is an elevation of a ribbon component of the puck-deflector of FIG. 8*a;*

Figure 9A:
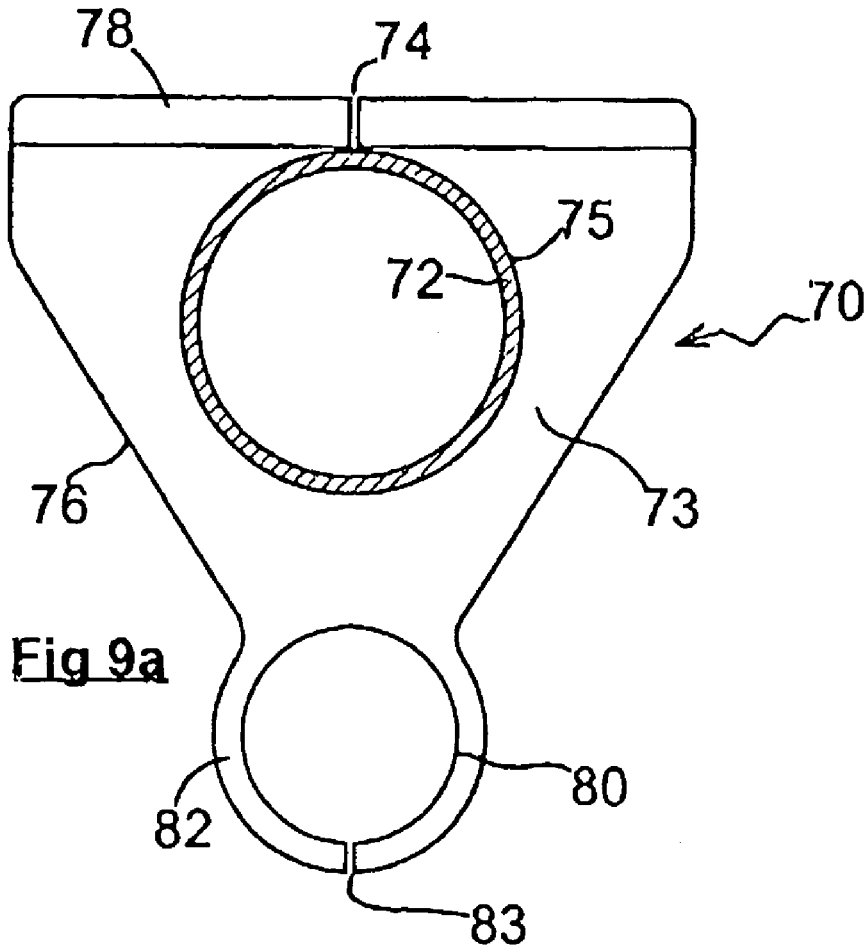
Figure 9B:
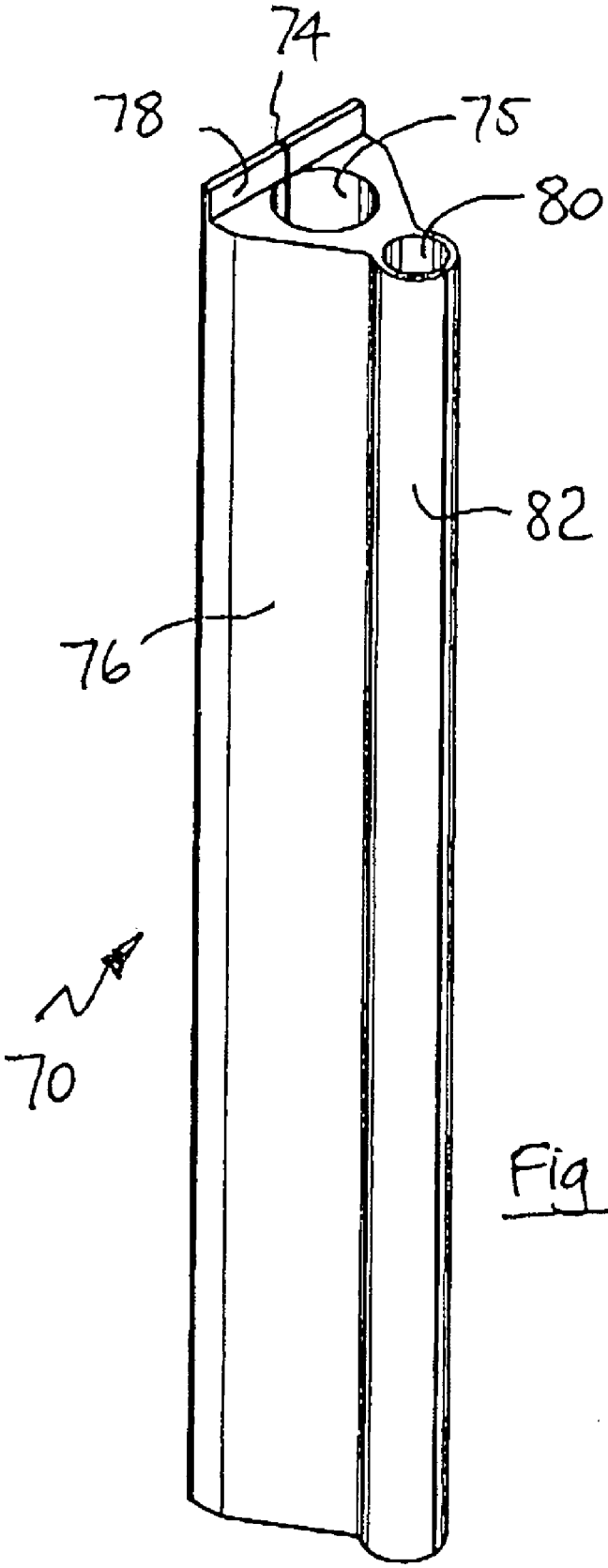

FIG. 9*a* is a plan view of a further puck-deflector;

FIG. 9*b* is an isometric view of the puck-deflector of FIG. 9*a;*

Figure 10:
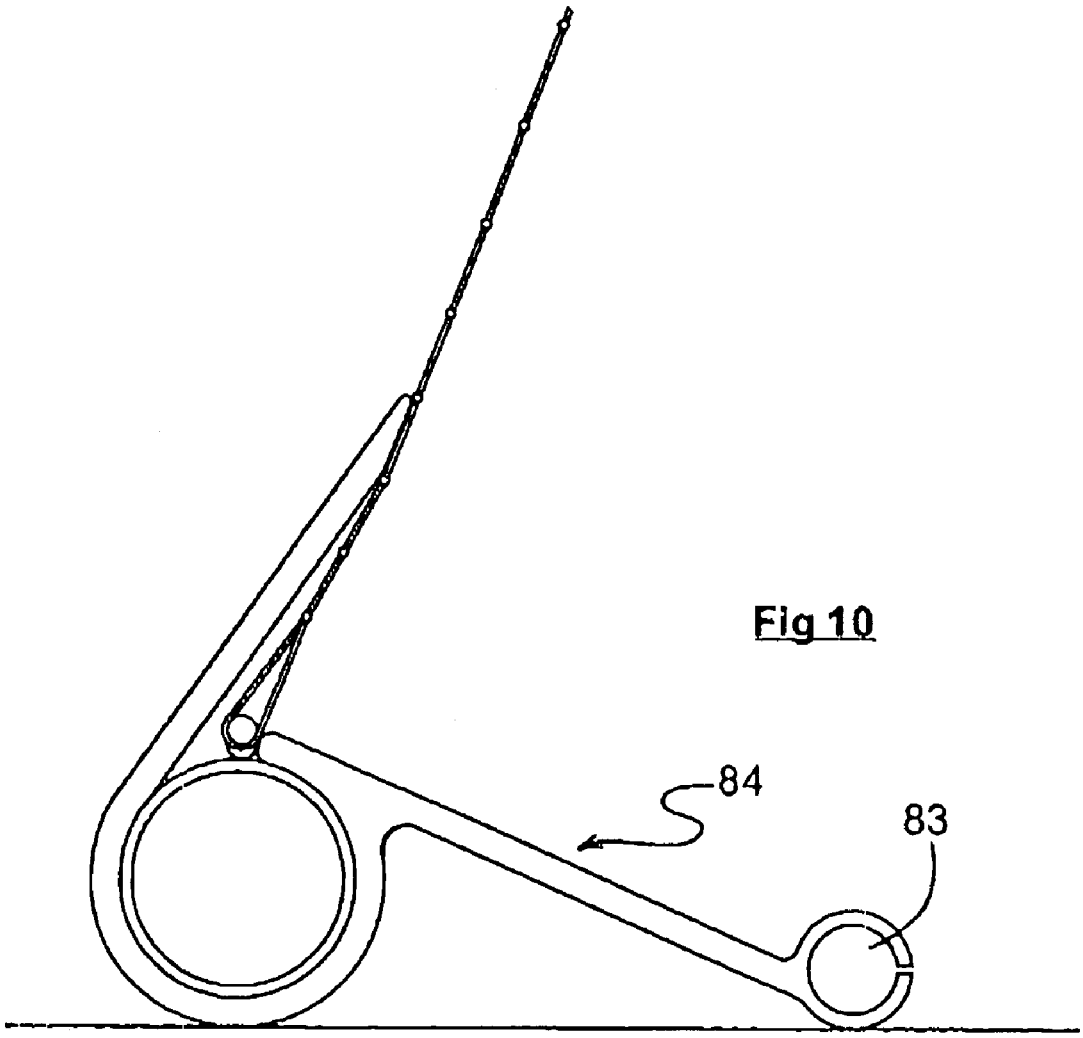
Figure 11:
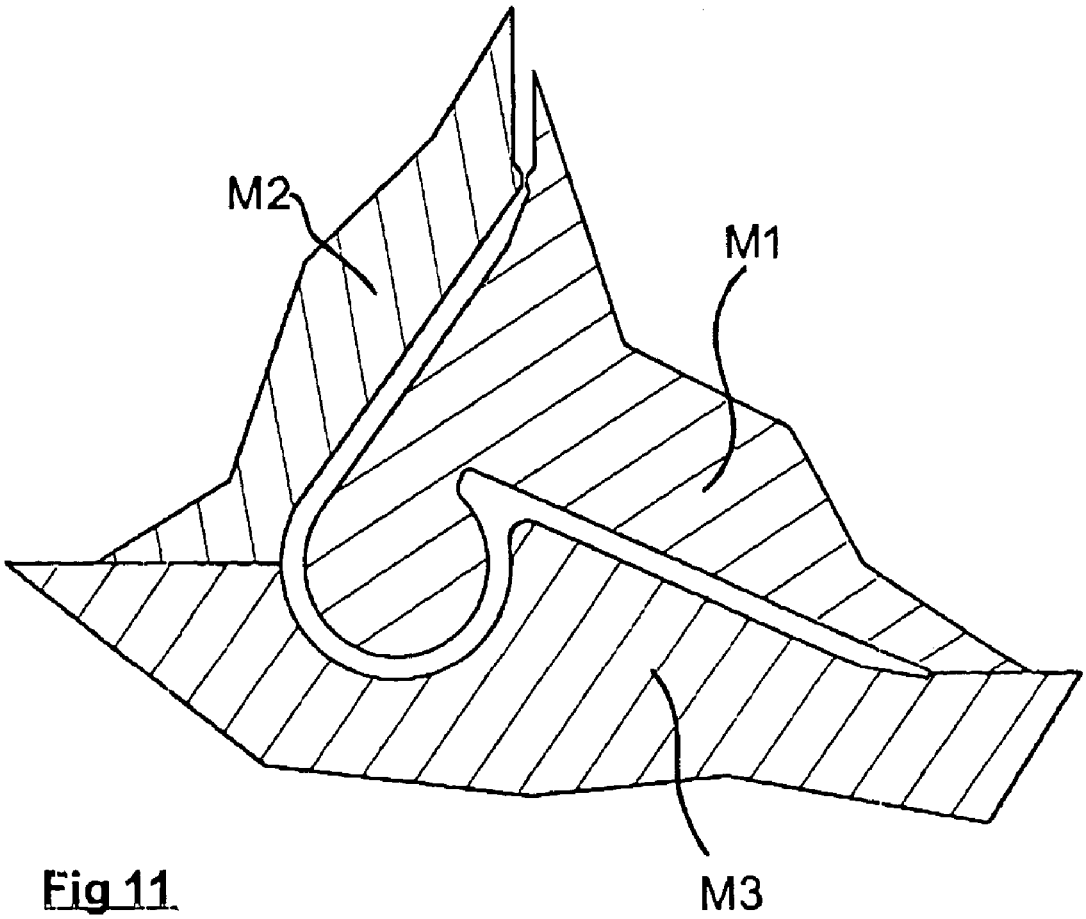

FIG. 10 is a section, like FIG. 3, of yet another embodiment;

FIG. 11 is a section illustrating an arrangement of mould components.

The apparatuses shown in the accompanying drawings and described below are examples which embody the invention. It should be noted that the scope of the invention is defined by the accompanying claims, and not necessarily by specific features of exemplary embodiments.

Figure 1:
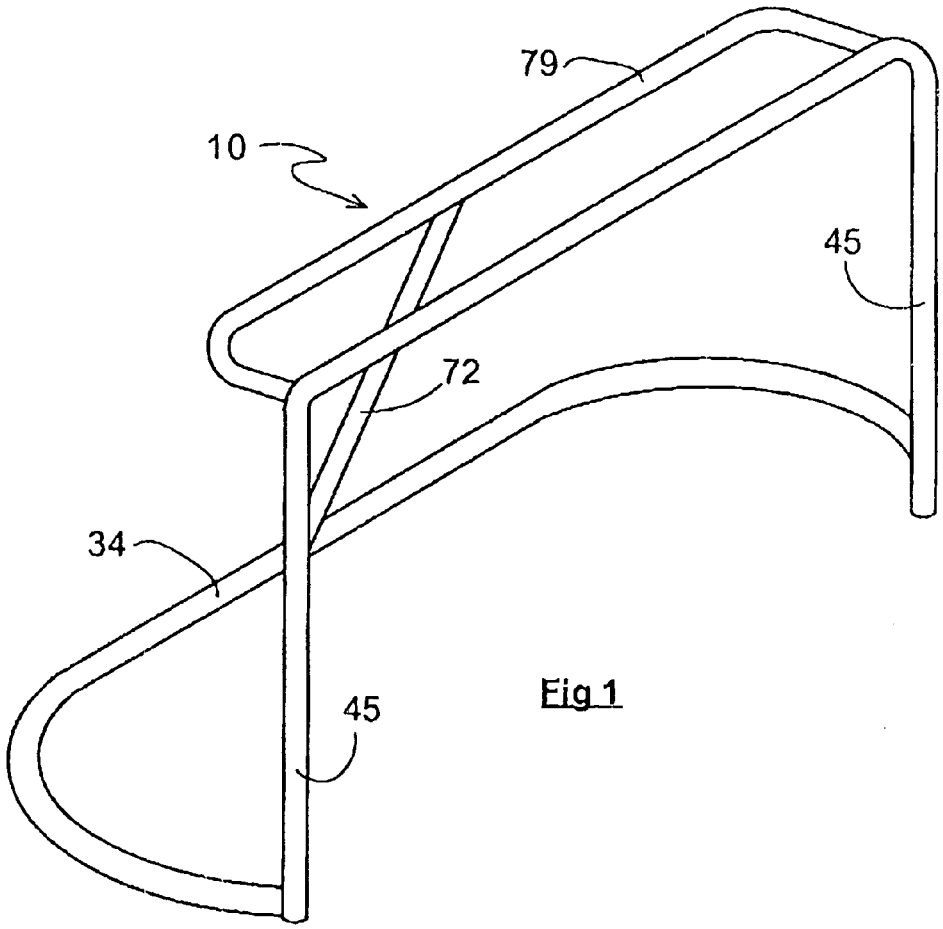

FIG. 1 shows a hockey goalframe 10, to which the puck-deflector 20 is applied. The goalframe 10 includes a crossbar, left and right goalposts, and a bottom-pipe, which are made from steel tubing of sixty millimetres diameter.

Figure 2:
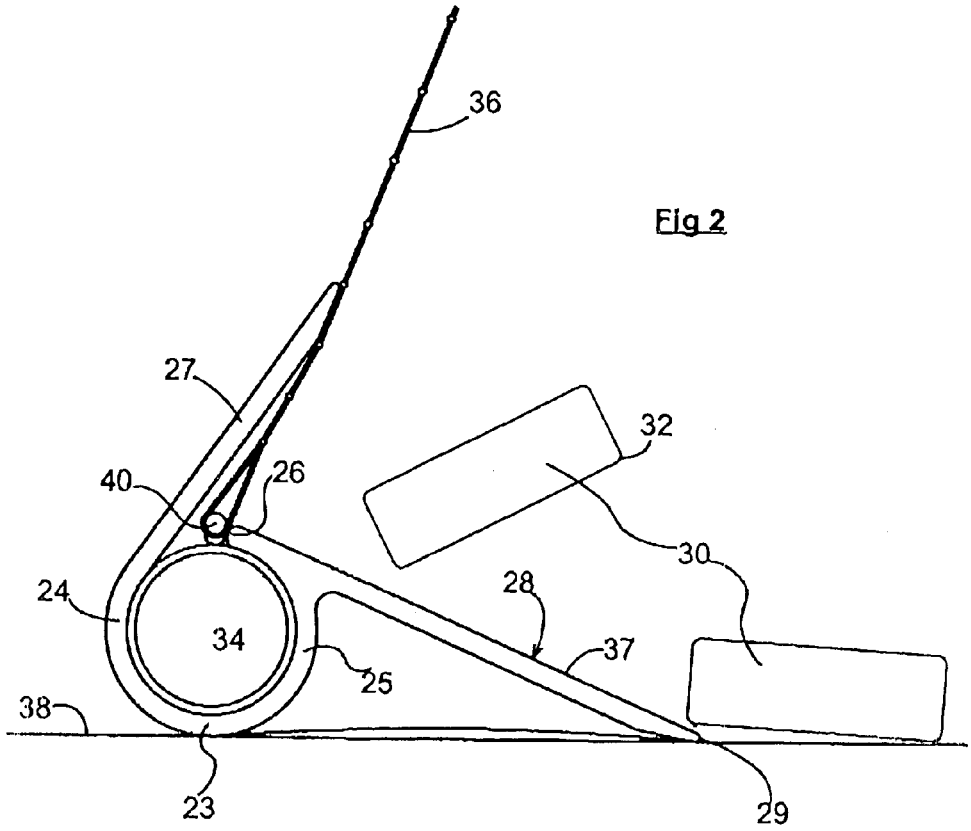

The cross-sectional profile of the puck-deflector 20, as shown in FIG. 2, includes an attachment zone, comprising an under-pipe portion 23, a behind-pipe portion 24, and a front-pipe portion 25. The front-pipe portion 25 extends to an abutment shoulder 26. The behind-pipe portion 24 extends upwards into a rear-skirt 27.

In front, the profile of the puck-deflector 20 includes an apron 28. The apron 28 slopes at an angle-A, which in the example is about twenty-five degrees to the horizontal. The angle-A should not be more than about thirty-five degrees, to make sure the puck flies upwards and into the net, whereby the puck tends not at all to rebound. An angle-A of forty degrees is about the limit of steepness. The angle-A should not be less than about twenty degrees; less than that, the apron would be too long.

(These angles apply to the profile of the puck deflector over its rain length. The profile of the portion of the puck deflector that lies just inside and behind the goalposts might be different.)

The front edge 29 of the apron 28 is shown in close-up in FIG. 3. A standard hockey puck 30 is three inches (7.6 cm) in diameter, and one inch (2.5 cm) thick. From the standpoint of causing the incoming puck to deflect upwards, i.e up and over the bottom-pipe 34 and into the mesh of the net 36, it would be desirable for the angled upper surface 37 of the apron 28 to extend right down to the ice surface 38. If the angled upper surface were to extend right down to the ice surface, then no matter how the incoming puck 30 was orientated when it struck the puck-deflector 20, the point of striking would be on the angled upper surface 37—even if the puck were right down on, i.e actually touching, the ice surface.

It is hardly possible for the slope of the upper surface 37 to be provided actually right down to the ice surface. In other words, it is hardly possible for the vertical height HA of the front edge 29 to be very small. The height HA of the front edge 29 is the height of point 39. Point 39 is the height (or the lowest height) at which the upper surface of the apron lies at an angle of forty degrees to the horizontal. Above the height HA, all points on the upper surface of the apron that can be struck by an incoming puck lie sloping at the angle-A (which is defined above.)

The function of the puck-deflector is to prevent pucks from bouncing out back over the goal line. The intention is that this no-bounce-back performance be achieved in that incoming pucks are rarely brought to a halt by impacting against the front edge and not bouncing, but rather are mostly brought to a halt by striking the sloping upper surface of the apron and being caught in the net.

The puck itself has a corner radius 32 of one or two millimetres. Thus, while the lowermost point of the angled upper surface 37 of the apron should be close to the ice surface 38, the height HA of the front edge can be above the ice surface, and still the puck cannot strike the front edge 29 square-on. Above the height HA, the point on the apron that will be struck (by an incoming puck) lies sloping at the angle-A. But below that height HA, the shape of the front edge is immaterial; below HA, it does not matter if the front edge slopes more steeply, is vertical, or slopes at a negative angle. The shape of the front edge of the apron, below the height HA, can be radiused, or can be of any shape, so long as the apron is sloping back at the angle-A, more than HA millimetres above the ice surface.

Preferably, the height HA should be within about five millimetres of the ice surface. A good proportion of incoming pucks Are more or less touching the ice at the moment of impact with the apron, and the higher HA, the more possible or likely it would be that the puck will strike the front edge, and bounce back therefrom, rather than striking the angled upper surface 37, and bouncing up into the net. A height HA of more than about ten millimetres is at the preferred limit of acceptability; if HA is less than that, (nearly) every puck will strike the angled upper surface 37.

On the other hand, there is also a preferred minimum to the height of the front edge 29. The designer should avoid taking the angled surface 37 of the apron 28 right down to the ice surface 38 (even if it were possible to do that). A sharp or narrow lip at the front-edge 29 would tend to become iced over, and stick to the ice surface. Tearing such a lip free, then, might damage it, rendering the puck-deflector unserviceable after only a small number of usages.

For this reason, the designer should see to it that the height HB of the forward-most extremity 31 of the front edge 29 is not less than two millimetres above the surface 38 of the ice. Below that height, the profile of the front edge 29 may notionally be e.g vertical, but it is easier simply to mould a blending radius onto the front edge, as shown, whereby, below the edge-point (i.e nearer the ice surface), the slope becomes progressively steeper and then becomes negative.

As mentioned, when the incoming puck 30 is travelling at high speed, it is likely that the puck is not actually touching the ice at the moment of impact with the puck-deflector. That being so, the first contact between the puck and the puck-deflector 20 will be a contact between the puck and some point on the sloping surface 37 of the apron. When that kind of contact occurs, the puck is deflected up and into the net. But if the leading edge of the incoming puck should happen to be touching, or very close to, the ice surface 38, the first contact between the puck and the puck-deflector might be on the forward-most extremity of the front-edge 29, i.e on the point at which the (tangent to the) front edge lies at a right angle to the ice surface. In that case, since the contact occurs close to the ice surface, the puck may be expected to "trip" over the front edge 29, and may be expected then to roll and tumble, whereby the puck flies upwards, and into the net. (In that case, the puck might or might not strike the sloping surface 31 before it is caught in the mesh of the net 36.)

Thus, it may be expected that the puck 30 will be deflected upwards and into the net 36, whether as a result of striking the sloping surface 37 of the apron 28, or as a result of tripping over the front edge 29 of the apron.

However, it cannot be ruled out that in a small proportion of cases, even if the height HA of the front edge is made very small, the puck might strike the forward-most extremity of the front-edge square-on and not be deflected up and into the net. In that case, the only thing preventing the puck from bouncing back, i.e bouncing back out over the goal-line, is the lack of resilience in the material of the puck-deflector.

With the prior art puck-deflector, made of metal, resilient bounce-back was inevitable. The plastic material, however, when impacted by the puck, will be indented and deformed as much as or more than metal, by the impact. But metal regains its former shape instantly, and thus imparts nearly all the kinetic energy of the impact back into the puck. The plastic material used in the invention, by contrast, should be selected for its deadness, i.e for its ability to recover from the impact-caused deformation only slowly, whereby the material regains its original shape considerably less rapidly than metal. Thus, the kinetic energy of the blow from the puck is absorbed into the plastic material (as heat, in fact), and the energy is not fed back to the puck kinetically.

An example of a plastic material that combines easy mouldability with this slow recovery of shape, upon being impacted, is polyurethane.

The puck-deflector 20 is pour-moulded in polyurethane. The liquid material is hot (typically sixty-five to eighty degrees centigrade) when poured into the mould. The melt is held at high temperature, in the region of seventy to hundred-ten degrees, in the mould, for a period of, typically, sixteen hours.

The moulded polyurethane material of the finished product should have a hardness of durometer-85, shore-A. At that, the material is hard enough and tough enough to stand up to the use and abuse associated with ice-hockey, with a long service life—in fact, it may be expected that the puck-deflector will last, if not as long as the metal tubing of the goalposts, bottom-pipe, etc, at least as long as the net 36.

The toughness of polyurethane, i.e its ability to withstand stress and strain (and its ability not to crumble at the edges) can be improved by the use of fillers, as is known generally. Suitable fillers for use in the present case include e.g carbon fibres or the like. Generally, the presence of fillers leaves polyurethane at least as dead as the unfilled material, as far as resilience and rebound characteristics are concerned.

The moulded polyurethane material as used in the invention may be unfilled, and it is recognised that the gain in toughness arising from the use of fillers may not be worth the extra expense in many cases.

Plastic materials other than polyurethane are contemplated within the scope of the invention. For example, some closed-cell foam materials can be hard enough to withstand the impacts of hockey pucks, and yet can be dead enough for use in the invention. When the puck-deflector is made from cellular material, the designer may seek to make the profile of the product more chunky, i.e without thin sections, since such materials can readily fill bulk spaces. It is noted that some closed-cell foam materials also have the ability to be simply pour-moulded.

The puck-deflector 20 is assembled to the goalframe 10 by pressing it onto the bottom-pipe 34 from underneath. The skirt 27 is prised back from the apron 28 to enable assembly. Assembly of the puck-deflector 20 is done in-factory, after the net 36 has been tied and tightened to the bottom pipe, goalposts, and crossbar of the goalframe. As mentioned, the intention is that the moulded plastic puck-deflector 20 will only be replaced when the net 36 is replaced. Therefore, ease of servicing is not required (as it was with the impact-bags, for instance, which have to be replaced more frequently than the nets). On the other hand, it will be noted that it is perhaps easier for an arena serviceperson to replace the one-piece, snap-on, plastic puck-deflector 20 than to replace the tie-on impact-bags.

In the embodiment as illustrated, the puck-deflector 20 is not intended to be tied or otherwise secured to the bottom-pipe 34. The puck-deflector remains firmly in place, secured to the bottom-pipe, simply by virtue of the shape of the attachment zone, i.e of the under-pipe portion 23, behind-pipe portion 24, and front-pipe portion 25.

The designer may prefer to provide some means whereby the front edge 29 of the apron 28 is urged down into contact with the ice surface 38. Ripple bars 40 are welded to the top surfaces of the bottom-pipe 34, and to the backwards-facing surfaces of the goalposts and crossbar, to provide anchorage points for tying down the net, and these ripple bars can provide an abutment that can be used for urging the front edge 19 down into contact with the ice. As shown in FIG. 2, the shoulder 26 engages with the ripple-rod 40; this engagement prevents the puck-deflector 20 from rotating in an anti-clockwise sense, and thus preventing the front edge 29 from rising.

Figure 6:
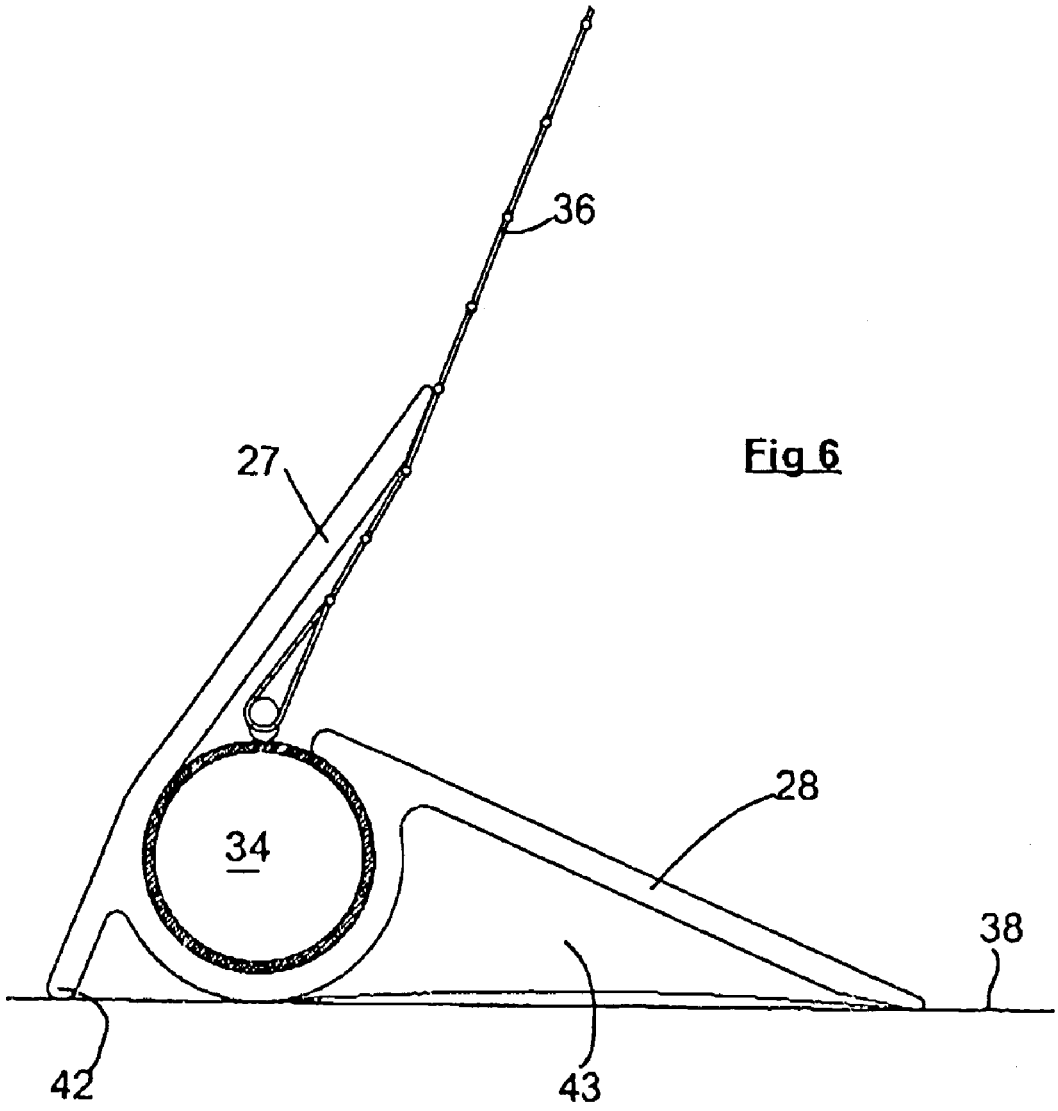
FIG. 6 is a section, like FIG. 3, of another embodiment.

In the embodiment illustrated in FIG. 6, the puck-deflector is prevented from rotating in an anti-clockwise sense by the provision of a protruding foot 42, which engages the ice surface behind the bottom-pipe 34.

Figure 4:
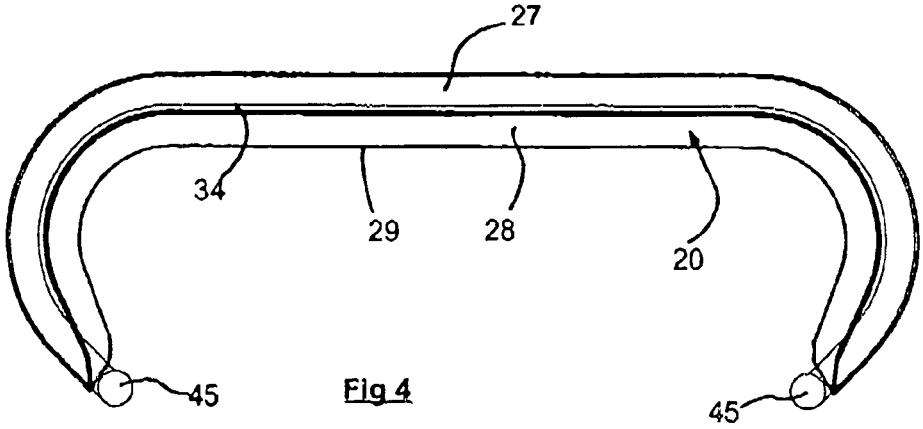
FIG. 4 is plan view of the bottom-pipe of FIG. 2 with the puck-deflector attached.
Figure 5:
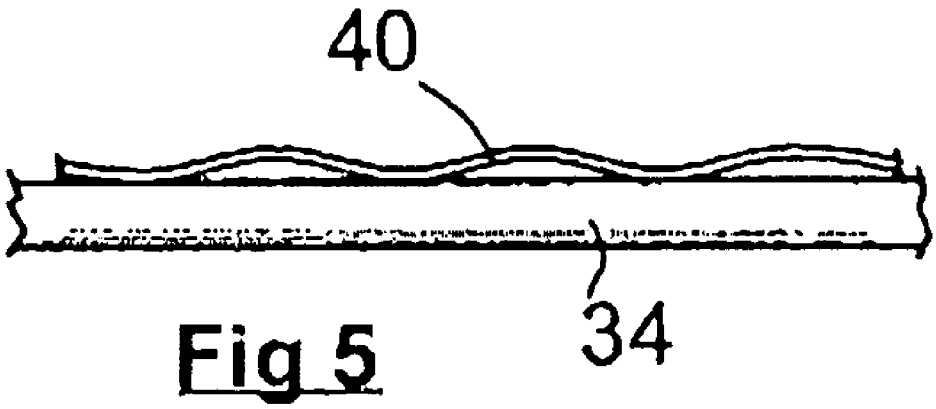
FIG. 5 is a rear elevation of the bottom-pipe, showing a ripple-bar.

It should be noted that it is not essential that such an abutment be provided, i.e an abutment against which some portion of the deflector can be pressed, in order to drive the front edge of the deflector downwards. It has been found that the front edge does tend to stay down in contact with the ice, i.e without tending to ride up, simply by virtue of the overall shape of the deflector (as shown in FIG. 4).

Moulded-in ribs 43 are provided at intervals under the apron 28 to reinforce and maintain the shape of the apron.

As shown in the plan view (FIG. 4), the moulded puck-deflector 20 follows the shape of the bottom-pipe 34 in plan view, in that the apron form continues almost right around the curve to the goalpost 45. However, the designer should be careful to taper off the apron form of the puck-deflector, in the portions just behind the goalposts 45, The designer's aim should be to ensure that every surface on the puck-deflector 20 is presented to an incoming puck in such a manner as to deflect the puck backwards, at least to a degree, and does not rebound, so the puck travels up and into the mesh of the net 36, no matter at what angle the puck is travelling prior to impact—even if (indeed, especially if) the puck crosses the goal-line just inside the goalpost 45. Again, rounding-off the front-facing portions of the deflector, as shown in FIG. 4, increases the chances that an at-ice-level incoming puck will be deflected inwards and upwards, into the net, rather than back out of the goal.

As mentioned, hockey goals have to be dragged over concrete floors, and this can cause abrasion to the under-surfaces. However, polyurethane, like many other plastics, is soft enough not to cause injury, even if it did have a sharpened edge.

The illustrated puck-deflector 20 is moulded in one piece. The one piece is assembled (in-factory) from underneath the goalframe 10, by snapping the moulding onto the bottom-pipe from underneath, and it is substantially impossible for the puck-deflector to become detached accidentally from the goalframe during the game. Even if the goal structure were to be knocked off its moorings, and tipped over on its side, the puck-deflector 20 probably would not come off. Yet no fasteners are needed to secure the puck-deflector 20 firmly in place. Indeed, no other components are required at all, other than the puck-deflector itself, especially when the skirt 27 is incorporated into the moulding.

No maintenance is required—not even inspection, in that the puck-deflector 20 can hardly be damaged without the damage showing. Even if the puck-deflector were to be damaged, it can hardly be imagined that it would be damaged in such a way as to pose an increased likelihood of injuring the players. Even less imaginable is it that there might be hidden damage (such as unexpected sharp edges) that might cause injury.

Figure 7:
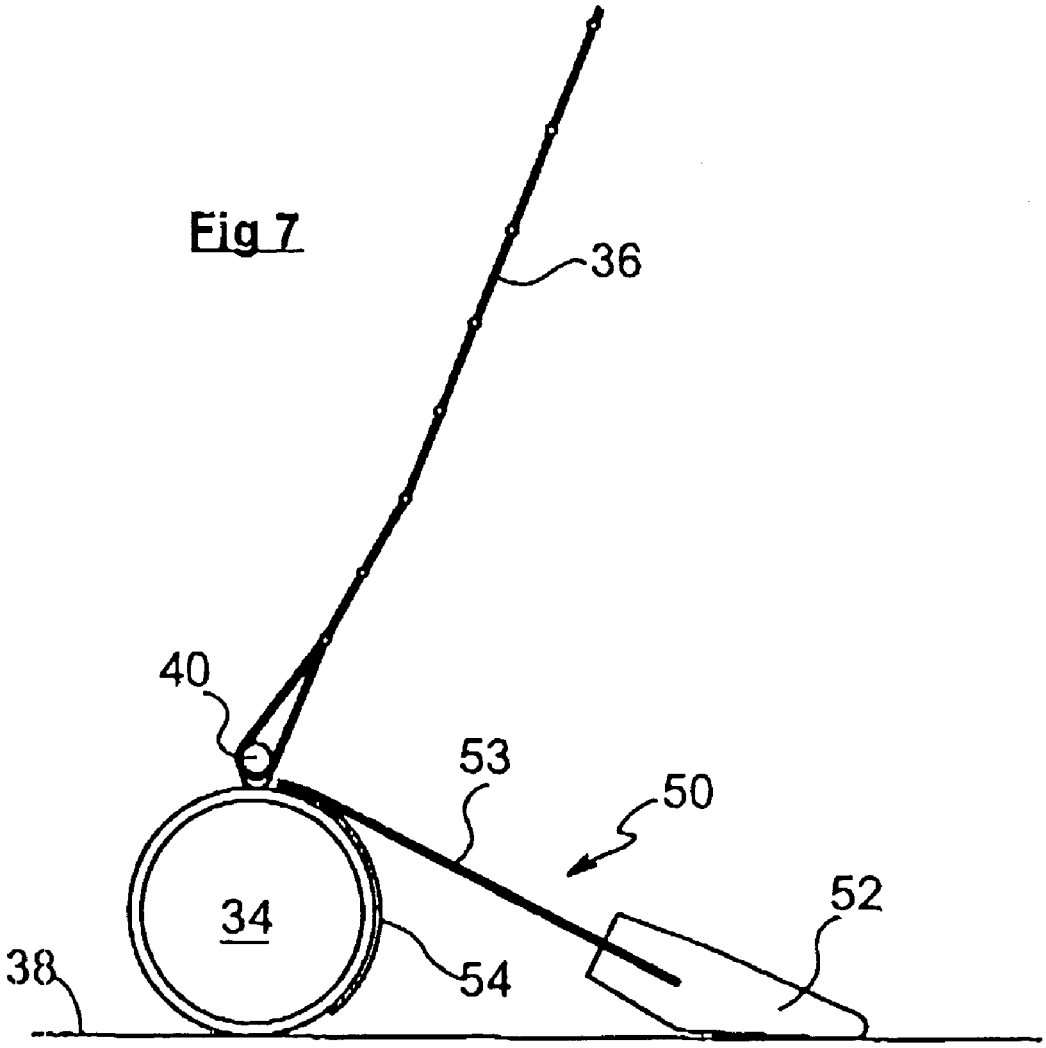
FIG. 7 is a section, like FIG. 3, of yet another embodiment.

FIG. 7 shows another embodiment. The puck-deflector 20 illustrated previously was formed as a moulding, in one piece, and no other components were required other than the one-piece moulding. But in FIG. 7, the puck-deflector 50 is of composite construction, having:—a nose-piece 52, which is of polyurethane, and which can be moulded in the manner as previously described; an apron plate 53, made of sheet metal; and a locating plate 54, also made of sheet metal. The puck-deflector 50 is secured to the bottom-pipe 34 by being tied (with cords, not shown) to the ripple-bar 40, rather than by being so shaped that it can be snapped over the bottom-pipe as previously described. Although the puck-deflector 50 includes components made of sheet metal, it will be understood as, again, only a remote possibility that the puck-deflector 50 might be damaged in such a way as to lead to injuries to the players.

It will be understood from a perusal of FIGS. 4 and 7 that the shape of the locating plate 54 in fact means that the puck-deflector has to be distorted in order to assemble it into its final assembled position on the bottom-pipe of the goalframe. By the same token, the deflector will have to be distorted in order for it to be removed from the goalframe; therefore, the puck-deflector resists being displaced from its assembled position on the bottom-pipe by virtue of its geometry and the geometry of the bottom pipe. In fact, the designer may decide to use this resistance to displacement as the sole means for holding the puck-deflector in place in the goalframe, whereby the puck-deflector 50 would not need any fasteners, such as the cords as mentioned.

Similarly, as regards the one-piece moulded plastic puck-deflector, it can be arranged that the puck-deflector will remain in place on the bottom-pipe, even though the under-pipe portion 23 and the behind-pipe portion 24 (and the skirt 27) are not present. Of course, if those portions are removed, the puck-deflector then will not be held quite so securely; but if that reduced degree of security can be accommodated a cost saving can be made. Also, if those portions are not present, the skirt, and some means for attaching the skirt, would then need to be separately provided, which would offset the cost savings.

The skirt 27 has been referred to in the above-described embodiments. The skirt serves to protect the lower portions of the netting from being damaged by skates. Experience shows that, without a skirt, the strings of the lower netting quickly become frayed and cut. Another function of the skirt is to prevent damage to the delicate edges of the skate blades, arising from impacts of the blades against the bottom pipe.

The skirt 27 is provided with lace-holes, whereby the top of the skirt can be laced into the netting. However, the cord used for lacing the skirt to the net is then exposed, and the cord can be vulnerable to being cut and damaged by skate blades. FIGS. 8*a*,8*b* show a modification to the skirt, which enables the skirt to be very securely laced to the netting, with no part of the lacing cords exposed to being damaged by skate blades. This is in keeping with the overall design aim of the apparatus as described herein, to provide a puck-deflector and unitary skirt that will last at least as long as the net, if not as long as the goal posts.

In FIGS. 8*a*,8*b*, a series of lacing-posts 60 have been moulded onto the inside surface of the skirt 62. These lacing-posts 60 protrude inwards through the apertures of the netting. When a lacing cord is passed through the holes 63 in the lacing-posts, the skirt 62 is attached very securely to the net. It cannot be stated that it is completely impossible for the thus-secured skirt to become detached from the netting, but it is almost so.

In place of a lacing cord, a lacing tape or ribbon 64 of e.g PVC, may be provided, which is perforated with holes 65 along its length (FIG. 8*c*). The spacing of the holes 65 corresponds to the pitch of the lacing-posts 60 (which is every three inches, typically). After the skirt 62 has been assembled to the goalframe 10, and the lacing-posts 60 have been pushed through the netting, the ribbon 64 is placed over the lacing-posts. The ribbon 64 is then locked into place with plastic pegs or screws 67. This is done in-factory, and again the intention is that the deflector will not need to be removed until the net is replaced.

The skirt 62 should be attached to the netting in such manner that there is no gap between the skirt and the netting that the puck might accidentally fall into.

FIGS. 9*a*, 9*b* show a backpipe-cover 70, which can be combined with the other puck-deflectors as described herein. The hockey goalframe 10 (FIG. 1) includes a backpipe 72. It can happen that a puck might strike the backpipe, and then bounce back out of the goal, and as explained it is desired that the puck should not bounce out. The backpipe-cover 70 prevents or reduces bounce-back from the backpipe 72.

The profile of the backpipe-cover 70 is shown in FIG. 9*a*. The profile includes a main body 73, which includes a lengthwise alit 74. The body is assembled over the backpipe 72 by prying open the slit 74 (which may be done by hand) and snapping the cylindrical pipe-aperture 75 over the backpipe 72.

The side faces 76 of the body 73 are (like the apron 28) angled to deflect the puck into the netting. An upward-protruding extension 78 (FIG. 9*b*) engages behind the top-bar 79 of the goalframe 10, to prevent the backpipe-cover 70 from rotating.

In front, the profile includes a cylindrical front-aperture 80, this one with thin walls 82. The front-aperture 80 may be slit lengthways, as shown at 83, although some designers may prefer not to provide the front slit. It will be understood that such a form, slit or not, will absorb substantially all of the kinetic energy of an incoming puck, whereby the puck simply falls or drops after the impact. The thickness of the walls 82 preferably should be between two and four millimetres.

The backpipe-cover 70 may be pour-moulded in polyurethane, foam, etc; or it may be extruded.

In an alternative puck-deflector, designers might prefer to incorporate a similar front-aperture 83, with or without a slit, into the front edge of the puck-deflector 84, as shown in FIG. 10.

In this specification, it is referred to that the plastic material is pour-moulded. This expression should be understood to mean that the mould remains open, i.e open to the atmosphere, or at least that the plastic liquid in the mould remains substantially unpressurised, during curing of the plastic. In pour-moulding, the liquid plastic (hot or cold) fills the mould simply by the action of gravity; the expression also encompasses the case where the liquid plastic is injected into the mould under (light) pressure, during filling, provided the plastic then remains substantially unpressurised during curing.

It is not essential, in the invention, that the puck-deflector be pour-moulded. However, pour-moulding has been found to be well-suited for manufacturing hockey goalframe puck-deflectors, in that pour-moulding enables the desired characteristic of deadness of the material, and also pour-moulding lends itself to small-batch production.

As to the structural arrangement of the moulds themselves: where the puck-deflector is to fit over the bottom pipe, the mould follows generally the shape of the bottom pipe, having the central straight portion and the left and right curved portions (see FIG. 4). Some designers might prefer to manufacture the straight central portion of the deflector as an extrusion, leaving only the left and right curved portions to be moulded, but generally the preference is to mould the whole deflector in one piece.

Preferably, the deflector is moulded the right way up, in a mould of the configuration shown in FIG. 11, the mould having three mould-components M1,M2,M3 as shown. These mould-components are bolted together, whereby they can be simply unbolted, after the plastic has cured, to extricate the moulded product.

The invention claimed is:

1. Hockey goalframe apparatus, wherein:

the apparatus is structurally suitable for use in the game of ice-hockey, on an ice-rink;

the apparatus includes a goalframe, which includes a bottom-pipe;

the apparatus includes a puck-deflector, which is so arranged in front of the bottom-pipe as to prevent the bottom-pipe from being directly struck by an incoming puck;

the puck deflector includes an apron, which is as high, vertically, as the bottom pipe, and which lies in front of the bottom pipe, and is extensive enough, as to its dimensions and position, to prevent an incoming puck from striking the bottom-pipe;

the apron includes a front-nose-piece;

the front-nose-piece has a vertical height that extends from the ice surface to at least half-way up the vertical height of the bottom-pipe;

in cross-sectional profile, the front-nose-piece has an angled upper-surface that is so angled that an incoming puck striking the angled upper-surface is directed upwards, and has an under-surface that lies in contact with the ice;

the material of the front-nose-piece is a dead plastic material, which either is polyurethane, or has substantially the same characteristic quality of deadness, from the standpoint of its lack of resilient recovery after being deformed by an impact from a hockey puck, as polyurethane;

in cross-sectional profile, the front-nose-piece, between its upper-surface and under-surface, has the form of a one-piece moulding of the said dead plastic material.

2. Apparatus of claim 1, wherein the plastic material is polyurethane.

3. Apparatus of claim 2, wherein the polyurethane material includes fillers, mixed into the material, the resulting filled material being structurally tougher, but riot more resilient, than the same material unfilled.

4. Apparatus of claim 2, wherein the polyurethane material is unfilled.

5. Apparatus of claim 1, wherein:

the goalframe apparatus includes a net;

the apron includes an angled upper surface, which is so configured that when an incoming puck strikes the said surface the puck is deflected upwards into the mesh of the net.

6. Apparatus of claim 5, wherein the angled upper surface is inclined at an angle such that, when a point on the surface is struck by an incoming puck, the surface at that point is no steeper than thirty-five degrees to the horizontal.

7. Apparatus of claim 6, wherein the angled upper surface extends forwards and downwards from the bottom-pipe to a point that is within about five millimetres of the ice surface.

8. Apparatus of claim 5, wherein:

in respect of every point on the apron that could be struck by an incoming puck, and which lies more than a height HA above the ice surface, the apron at that point lies sloping at an angle-A to the horizontal;

the height HA is less than ten millimetres;

the angle-A is less than forty degrees.

9. Apparatus of claim 8, wherein the height HA is less than five millimetres.

10. Apparatus of claim 8, wherein the angle-A is less than thirty-five degrees.

11. Apparatus of claim 1, wherein the whole apron including the front-nose-piece of the puck-deflector, is, in cross-sectional profile, in the form of a one-piece polyurethane moulding.

12. Apparatus of claim 1, wherein:

the puck-deflector has been formed as a moulding in polyurethane;

in making the moulding, hot polyurethane melt was poured into a mould, at a temperature of more than sixty-five deg-C;

and the melt was maintained at a temperature of more than seventy deg-C, in the mould, over a period of several hours, before cooling.

13. Apparatus of claim 12, wherein:

the goalframe apparatus includes a net;

the apron includes an angled upper surface, which is so configured that when an incoming puck strikes the said surface the puck is deflected upwards into the mesh of the net;

the angled upper surface is inclined at an angle such that, when a point on the surface is struck by an incoming puck, the surface at the point is no steeper than thirty-five degrees to the horizontal;

the angle upper surface extends forwards and downwards from the bottom-pipe to a point that is within about five millimetres of the ice surface;

in respect of every point on the apron that could be struck by an incoming puck, and which lies more than a height HA above the ice surface, the apron at that point lies sloping at an angle-A to the horizontal;

the height HA is less than ten millimetres;

the angle-A is less than forty degrees, the apron has a front-edge, which faces towards an incoming puck, and which contains the forward-most extremity of the apron;

in profile of the front-edge of the apron, the front edge is radiused such that the forward-most tip of the front edge is at least two and no more than five millimetres off the ice surface;

every point on the froward edge of the apron that is less than the height HB above the ice-surface lies sloping either at a steeper angle than forty degrees or lies sloping in the opposite sense from the slope on the upper angle surface of the apron;

the height HB is less than five millimetres;

the attachment region includes and under-pipe portion, a behind-pipe portion, and a front-pipe portion;

the said portions are so configured that, when assembled onto the bottom-pipe from underneath, they act to grip the bottom-pipe, and thereby to attach the puck-deflector to the goalframe;

the puck-deflector, including the apron and the attachment region, is done as a one-piece polyurethane moulding;

the material of the puck-deflector is so prepared and formed as to have a hardness of between durometer-55 and durometer-85, shore-A.

14. Apparatus of claim 12, wherein:

the moulding has a cross-sectional profile; and the moulding is a one-piece moulding, at least as to its cross-sectional profile.

15. Apparatus of claim 1, wherein:

the front-nose-piece has a front-edge, which faces towards an incoming puck, and which contains the forward-most extremity of the apron;

in profile of the front-edge of the apron, the front-edge is radiused such that the forward-most tip of the front-edge is at least two and no more than five millimetres off the ice surface.

16. Apparatus of claim 1, wherein:

every point on the front-nose-piece that is less than a height HB above the ice-surface lies sloping either at a steeper angle than forty degrees or lies sloping in the opposite sense from the slope on the upper angled surface of the apron;

the height HB is less than five millimetres.

17. Apparatus of claim 16, wherein the height HB is less than two millimetres.

18. Apparatus of claim 1, wherein:

the puck-deflector includes an attachment region; and the attachment region is so configured that, when assembled onto the bottom-pipe of the goalframe, it acts to grip the bottom-pipe, and thereby to attach the puck-deflector to the goalframe.

19. Apparatus of claim 18, wherein the whole apron including the front-nose-piece, and the attachment region of the puck-deflector, is, in cross-sectional profile, in the form of a one-piece polyurethane moulding.

20. Apparatus of claim 18, wherein the material of the puck-deflector is so prepared and formed as to have a hardness of between durometer-55 and durometer-85, shore-A.

21. Apparatus of claim 18, wherein:

the attachment region includes a skirt that lies outside and behind the bottom pipe, and extends upwards above the bottom pipe in such manner as to overlie a region of the net that is adjacent to the bottom pipe;

the skirt is provided with lacing-posts, which protrude inwards through the apertures of the netting, for securing skirt and net together.

22. Hockey goalframe apparatus, wherein:

the apparatus is structurally suitable for use during the game of ice-hockey, on an ice-rink;

the apparatus includes a goalframe, of metal, which includes a bottom-pipe;

the apparatus includes a puck-deflector, which is so arranged in front of the bottom-pipe as to prevent the bottom-pipe from being directly struck by an incoming puck;

the puck-deflector includes a front-edge, which is defined as that edge of the puck-deflector that is first impacted by an incoming puck that is in contact with the surface of the ice;

the puck-deflector, at least in respect of the said front-edge, is made from a plastic material;

the plastic material has the characteristic of being as dead, from the standpoint of its lack of resilient recovery after being deformed by an impact, as polyurethane; and the puck-deflector includes an abutment shoulder, which, in use, serves to prevent the front-edge from lifting off the ice-surface.

23. Apparatus of claim 22, wherein the abutment shoulder abuts against a ripple-bar on the bottom-pipe.

24. Apparatus of claim 22, wherein the abutment shoulder abuts against the ice-surface behind the bottom-pipe.

25. Hockey goalframe apparatus, wherein;

the apparatus is structurally suitable for use in the game of ice-hockey, on an ice-rink;

the apparatus includes a goalframe, of metal, which includes a bottom-pipe;

the apparatus includes a puck-deflector, which is so arranged in front of the bottom-pipe as to prevent the bottom-pipe from being directly struck by an incoming puck;

the puck-deflector includes a front-edge, which is defined as that edge of the puck-deflector that is first impacted by an incoming puck that is in contact with the surface of the ice;

the puck-deflector, at least in respect of the said front-edge, is made from a plastic material;

the plastic material has the characteristic of being as dead, from the standpoint of its lack of resilient recovery after being deformed by an impact, as polyurethane;

the front-edge of the puck-deflector, being that edge of the puck-deflector that is first impacted by an incoming puck that is in contact with the surface of the ice, is of an impact-deadening structure;

the front-edge impact-deadening structure is of such form that the structure is able to deflect, under impact from the puck, over a sufficient distance, and with sufficient resistance to deflection, as to absorb substantially all the kinetic energy of the incoming puck;

whereby a puck striking the front-edge impact-deadening structure is brought substantially to rest, substantially without bouncing back.

26. Apparatus of claim 25, wherein the front-edge impact-deadening structure has the form of a thin-walled hollow enclosure.

27. Apparatus of claim 26, wherein the goalframe includes a backpipe, and the said front-edge impact-deadening structure is included in a portion of the puck-deflector applied to the backpipe.

28. Puck deflector, wherein:

the puck-deflector is structurally suitable for fitment to the bottom pipe of a hockey goalframe, and when so fitted is structurally suitable for use in the game of ice-hockey, on an ice-rink;

the puck-deflector is so structured as to prevent the bottom-pipe from being directly struck by an incoming puck;

the puck deflector includes an apron, which is adapted to lie in front of the bottom pipe, and is extensive enough, as to its dimensions and position, to prevent an incoming puck from striking the bottom-pipe;

the puck-deflector, at least in respect of the sad apron, is made from a dead plastic material;

the plastic material has the characteristic of being as dead, from the standpoint of its lack of resilient recovery after being deformed by an impact, as polyurethane.

29. Puck-deflector of claim 28, wherein:

the puck-deflector includes an attachment region;

the attachment region is so configured that, when assembled onto the bottom-pipe of the goalframe, it acts to grip the bottom-pipe and thereby to attach the puck-deflector to the goalframe.

30. A mould for pour-moulding the puck-deflector of claim 29 in polyurethane, where the mould is separable into three mould-components.

31. Puck-deflector of claim 29, wherein the whole puck-deflector of the goalframe apparatus is a one-piece plastic moulding.

32. Puck-deflector of claim 29, wherein:

the attachment region includes an under-pipe portion, a behind-pipe portion, and a front-pipe portion; and the said portions are so configured that, when assembled onto the bottom-pipe of the goalframe, from underneath, they act to grip the bottom-pipe.

33. Hockey goalframe apparatus, wherein:

the apparatus is structurally suitable for use in the game of ice-hockey, on an ice-rink;

the apparatus includes a goalframe, of metal, which includes a bottom-pipe;

the apparatus includes a puck-deflector, which is so arranged in front of the bottom-pipe as to prevent the bottom-pipe from being directly struck by an incoming puck;

the puck-deflector includes a front-edge, which is defined as that edge of the puck-deflector that is first impacted by an incoming puck that is in contact with the surface of the ice;

the puck-deflector, at least in respect of the said front-edge, is made from a plastic material;

the plastic material has the characteristic of being as dead, from the standpoint of its lack of resilient recovery after being deformed by an impact, as polyurethane;

the attachment region includes an under-pipe portion, a behind-pipe portion, and a front-pipe portion; and the said portions are so configured that, when assembled onto the bottom-pipe of the goalframe, from underneath, they act to grip the bottom-pipe.

* * * * *